US005422862A

United States Patent [19]

Wisor

[11] Patent Number: 5,422,862

[45] Date of Patent: Jun. 6, 1995

[54] COMPUTER SYSTEM EMPLOYING AN IMPROVED REAL TIME CLOCK ALARM

[75] Inventor: Michael T. Wisor, Austin, Tex.

[73] Assignee: Advanced Micro Devices, Inc., Sunnyvale, Calif.

[21] Appl. No.: 247,092

[22] Filed: May 20, 1994

[51] Int. Cl.[6] ..... G04B 47/00; G04B 19/24

[52] U.S. Cl. ..... 368/10; 368/28; 368/73; 364/705.08

[58] Field of Search ..... 368/10, 28, 72–74, 368/250; 564/705.07, 705.08

[56] References Cited

U.S. PATENT DOCUMENTS 3,999,050 12/1976 Pijroda .

5,333,295 7/1994 Podkowa ..... 395/425

*Primary Examiner*—Vit W. Miska

*Attorney, Agent, or Firm*—Conley, Rose & Tayon

[57] ABSTRACT

A set of I/O indexed configuration registers are provided within a real time clock circuit of a computer system to allow the storage of the day, month and century for an alarm activation event. The I/O indexed configuration registers that store the alarm year, the alarm month, and the alarm day information are shadowed with respect to the I/O indexed configuration registers that store the current year, month, and day information for the real time clock circuit. An additional configuration register mapped within the configuration space of the computer system is provided that stores a bit that controls whether the configuration registers for the current year, month, and day will be accessed during an I/O cycle to a predetermined address of the indexed configuration registers, or whether the configuration registers for the alarm year, alarm month, and alarm day will be accessed during an I/O cycle to the predetermined address. In accordance with the improved real time clock alarm, system software is not required to track the year, day, and month associated with a desired alarm event. In addition, additional I/O space and index space is not occupied as a result of the additional indexed configuration registers. Accordingly, broad system compatibility is maintained.

19 Claims, 2 Drawing Sheets

COMPUTER SYSTEM EMPLOYING AN IMPROVED REAL TIME CLOCK ALARM

BACKGROUND OF THE INVENTION

1. Field of the Invention

This invention relates to computer systems and more particularly to real time clock (RTC) alarm circuits employed within computer systems.

2. Description of the Relevant Art

In modern computer systems, a real time clock (RTC) circuit is typically employed to keep track of the time of day. A typical RTC can be programmed to produce or generate an RTC alarm event at a designated time. The RTC alarm event may cause, for example, the assertion of an interrupt signal to the microprocessor.

Within a typical model 80486-based system, a set of I/O indexed configuration registers are mapped at a pre-designated I/O region of the computer system to store the current time and date as well as the time at which an RTC alarm event is desired. However, configuration registers are not allocated for storing the day, the month, or the year of a desired RTC alarm event. As a result, system software must be configured to keep track of the particular day, month, and year for a desired RTC alarm event if such selectivity is desired. In other words, the RTC alarm for a model 80486 system will occur twice (or once) per day, and system software must keep track of each RTC alarm to determine whether it is the designated day, month, and year for triggering a desired system response.

An RTC alarm is typically employed within power managed portable computer systems that utilize suspend (i.e., power-down) and resume features. Such computer systems can be programmed to suspend or resume at a specific date and time. Since the RTC alarm event will occur once or twice every 24 hours, the system management software must keep track of the alarm events to determine the specific day, month, and year at which a particular RTC alarm event occurred. This adds to the system overhead and also degrades battery life since the computer system must be resumed to evaluate (via software) each alarm event. That is, if a specific date is specified by the programmer to trigger a particular event, the computer system software must turn on the computer system up to twice a day to determine whether the desired date has arrived.

A further complication is that for most computer systems, memory space and I/O space are distributed across several physical devices and are often limited. Typical computer systems have undergone a complex evolutionary path with respect to the mapping of memory and I/O space in order to maintain backwards compatibility with existing hardware and software. As a result of this complex evolutionary path, the allocation of additional I/O index space for additional RTC alarm functions may conflict with the predefined I/O index mapping of other I/O peripheral devices. As a result, changes in the hardware (i.e., the number of indexed configuration registers) associated with the RTC alarm to reduce the overhead of the system software could adversely affect the overall compatibility of the computer system with other I/O peripherals.

SUMMARY OF THE INVENTION

The problems outlined above are in large part solved by a computer system employing an improved real time clock alarm in accordance with the present invention. In one embodiment, a set of I/O indexed configuration registers are provided within a real time clock circuit of a computer system to allow the storage of the day, month and century for an alarm activation event. The I/O indexed configuration registers that store the alarm year, the alarm month, and the alarm day information are shadowed with respect to the I/O indexed configuration registers that store the current year, month, and day information for the real time clock circuit. An additional configuration register mapped within the configuration space of the computer system is provided that stores a bit that controls whether the configuration registers for the current year, month, and day will be accessed during an I/O cycle to a predetermined address of the indexed configuration registers, or whether the configuration registers for the alarm year, alarm month, and alarm day will be accessed during an I/O cycle to the predetermined address. In accordance with the improved real time clock alarm, system software is not required to track the year, day, and month associated with a desired alarm event. In addition, additional I/O space and index space is not occupied as a result of the additional indexed configuration registers. Accordingly, broad system compatibility is maintained.

Broadly speaking, the present invention contemplates a real time clock circuit for a computer system comprising a first register for storing a value indicative of the current time, a second register for storing a value indicative of the current day, a third register for storing a value indicative of a time for a desired RTC alarm event, and a fourth register for storing a value indicative of a day for the desired RTC alarm event. The real time clock circuit further comprises an index decoder coupled to the first, the second, the third, and the fourth registers, wherein the index decoder is capable of selecting at least one of the registers depending upon an index value. An index register is coupled to the index decoder for storing the index value. The real time clock circuit finally comprises a configuration register for storing a configuration bit, wherein the configuration bit controls whether the third register or the fourth register is enabled during a designated I/O cycle.

The invention further contemplates a method for operating a real time clock circuit within a computer system comprising the steps of setting a configuration bit of a configuration register in a first state to enable a first set of registers, storing a value indicative of the current time within a first register of the first set of registers, storing a value indicative of the current day within a second register of the first set of registers, and storing a value indicative of a time for a desired RTC alarm event within a third register of the first set of registers. The method comprises the further steps of setting the configuration bit of the configuration register in a second state to enable a fourth register wherein the fourth register is associated with an I/O index value which is the same as an I/O index value associated with either the first of the second register, and storing a value indicative of a day for the desired RTC alarm event into the fourth register.

BRIEF DESCRIPTION OF THE DRAWINGS

Other objects and advantages of the invention will become apparent upon reading the following detailed description and upon reference to the accompanying drawings in which.

Figure 1:
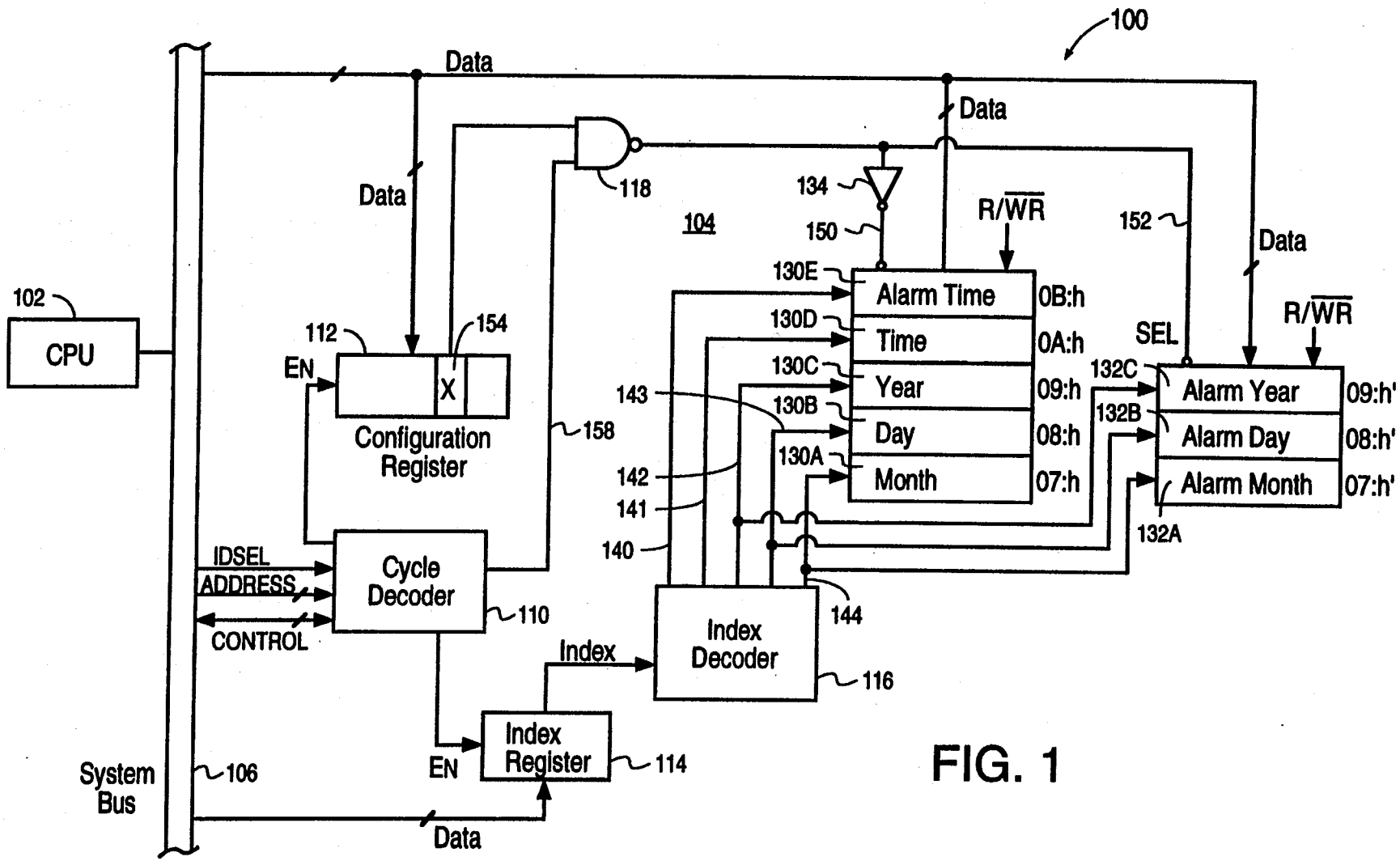
FIG. 1 is a block diagram of a computer system employing an improved real time clock in accordance with the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE INVENTION

Referring now to the drawings, FIG. 1 is a block diagram of a computer system 100 including a microprocessor (CPU) 102 coupled to a real time clock (RTC) circuit 104 via a system bus 106. Microprocessor 102 is a data processing unit that implements a predetermined instruction set. Exemplary processing units include the models 8386 and 8486 microprocessors, among others. System bus 106 is illustrative of, for example, a PCI (Peripheral Connect Interface) bus. It is understood, however, that other bus standards such as the ISA (Industry Standard Architecture) or EISA (Extended Industry Standard Architecture) bus standards could be alternatively employed.

Generally speaking, real time clock circuit 104 is provided for tracking the current time. Real time clock 104 is also associated with an alarm mechanism that allows a programmer to set a time and date at which an alarm event is desired. As will be appreciated by those skilled in the art, the occurrence of an RTC alarm may be used to control or activate a variety of system management functions such as power management functions.

In its illustrated form, real time clock circuit 104 includes a cycle decoder 110 coupled to system bus 106 and a configuration register 112 coupled to cycle decoder 110. An index register 114 is further coupled to cycle decoder 110. An index decoder 116 is coupled to index register 114, and an AND gate 118 is coupled at respective input terminals to configuration register 112 and cycle decoder 110. A first set of configuration registers 130A–130E and a second set of configuration registers 132A–132C are further coupled to index decoder 116. An inverter 134 is finally coupled to an output terminal of AND gate 118.

Configuration register 130A is provided for storing the current month, configuration register 130B is provided for storing the current day, configuration register 130C is provided for storing the current year, and configuration register 130D is provided for storing the current time. The values stored by configuration register 130A–130D are controlled by a clock control circuit (illustrated in FIG. 2). Configuration register 130E is finally provided for storing the time of a desired alarm event.

Index register 114 is mapped at a predetermined I/O address of computer system 100. In the preferred embodiment, index register 114 is mapped at the I/O address 70:H. Index register 114 is provided for storing an index value which points to one of the configuration registers 130A–130E. Index decoder 116 receives the index value from index register 114 and asserts an enable signal at one of lines 140–144. Thus, index decoder 116 selects which of the configuration registers 130A–130E may be accessed (i.e., either read or written) during an I/O cycle to a second predetermined I/O address location referred to as the RTC configuration data register location. In one embodiment, the RTC configuration data register location is mapped at I/O address 71:H.

Configuration register 132A is provided for storing the month of the desired alarm event, configuration register 132B is provided for storing the day of the desired alarm event, and configuration register 132C is provided for storing the year of the desired alarm event. Similar to configuration registers 130A–130C, configuration registers 132A–132C are selected by the signals at lines 142–144 from index decoder 116. In the preferred embodiment, configuration registers 130A and 132A are selected by index decoder 116 when a value of 07:H is stored within index register 114, configuration registers 130B and 132B are selected when a value of 08:H is stored within index register 114, and configuration registers 130C and 132C are selected when a value of 09:H is stored within index register 114. Configuration registers 130D and 130E are finally selected by index decoder 116 when values of 0A:H and 0B:H are stored within index register 114.

Although configuration registers 130A and 132A are selected by the same index value (and configuration registers 130B, 132B and configuration registers 130C, 132C are selected similarly), only one of the registers may be enabled during a given cycle in accordance with a pair of complementary enable signals at lines 150 and 152. When an I/O cycle is executed to the RTC configuration data register address, a bit 154 within configuration register 112 controls which of the configuration registers 130A–130E or 132A–132C are enabled via lines 150 and 152, respectively.

For example, consider a situation in which the current month, day, year, and time are stored within configuration registers 130A–130D, respectively. If the user desires a particular alarm event to occur at 2 o'clock on Oct. 15, 1999, the real time clock 104 can be programmed in the following manner. First, to set the alarm time, the bit 154 of configuration register 112 must be low. This low value may be set by default, or may be caused by executing a cycle to the configuration space of computer system 100 to which configuration register 112 is mapped. After properly setting the bit 154 of configuration register 112 low, and index value of 0B:H must be written to index register 114 to select the configuration register 130E. This is accomplished by executing an I/O write cycle to the I/O address of index register 114 (which is, in the preferred embodiment, mapped at I/O address 70:H). Once configuration register 130E has been selected in accordance with the index value of index register 114, an I/O write cycle may be executed on system bus 106 to store the alarm time data (i.e., corresponding to 2 o'clock) within configuration register 130E. This is accomplished by executing an I/O write cycle to the RTC configuration data register address, which is, in the preferred embodiment, mapped at address 71:H. It is noted that during such and I/O cycle, cycle decoder 110 drives the line 158 high, which causes the output of AND gate 118 to go high. Line 150 responsively goes low, and configuration register 130E is thereby enabled. It is further noted that cycle decoder 110 generates an appropriate read/-write control signal which is provided to each of the configuration registers.

After the desired alarm time has been stored within configuration register 130E, the desired alarm month, alarm day, and alarm year data must be stored in turn within configuration registers 132A–132C respectively. In order to enable configuration registers 132A–132C, however, the bit 154 of configuration register 112 must be set high. Similar to the previous description, the bit 154 of configuration register 112 may be set by executing a write cycle to the configuration address to which configuration register 112 is mapped (note that the configuration space of computer system 100 is accessed by asserting the PCI signal IDSEL). Subsequently, an appropriate index value (i.e., 07:H–09:H) may be written into index register 114 to select one of the configuration registers 132A–132C, and an I/O write cycle to the configuration data register address (I/O address 71:H) may be executed to write the appropriate data into the selected configuration register 132A–132C. Similar cycles may be initiated to write the remaining alarm information into the remaining configuration registers 132A–132C.

It is noted that although configuration registers 130A and 132A are selected simultaneously by index decoder 116 (i.e., when the index value is 07:H), only one of the configuration registers can be enabled by cycle decoder 110 at a given time in accordance with the enable signals at lines 150 and 152. The same is true for configuration register 130B, 132B and 130C, 132C.

Figure 2:
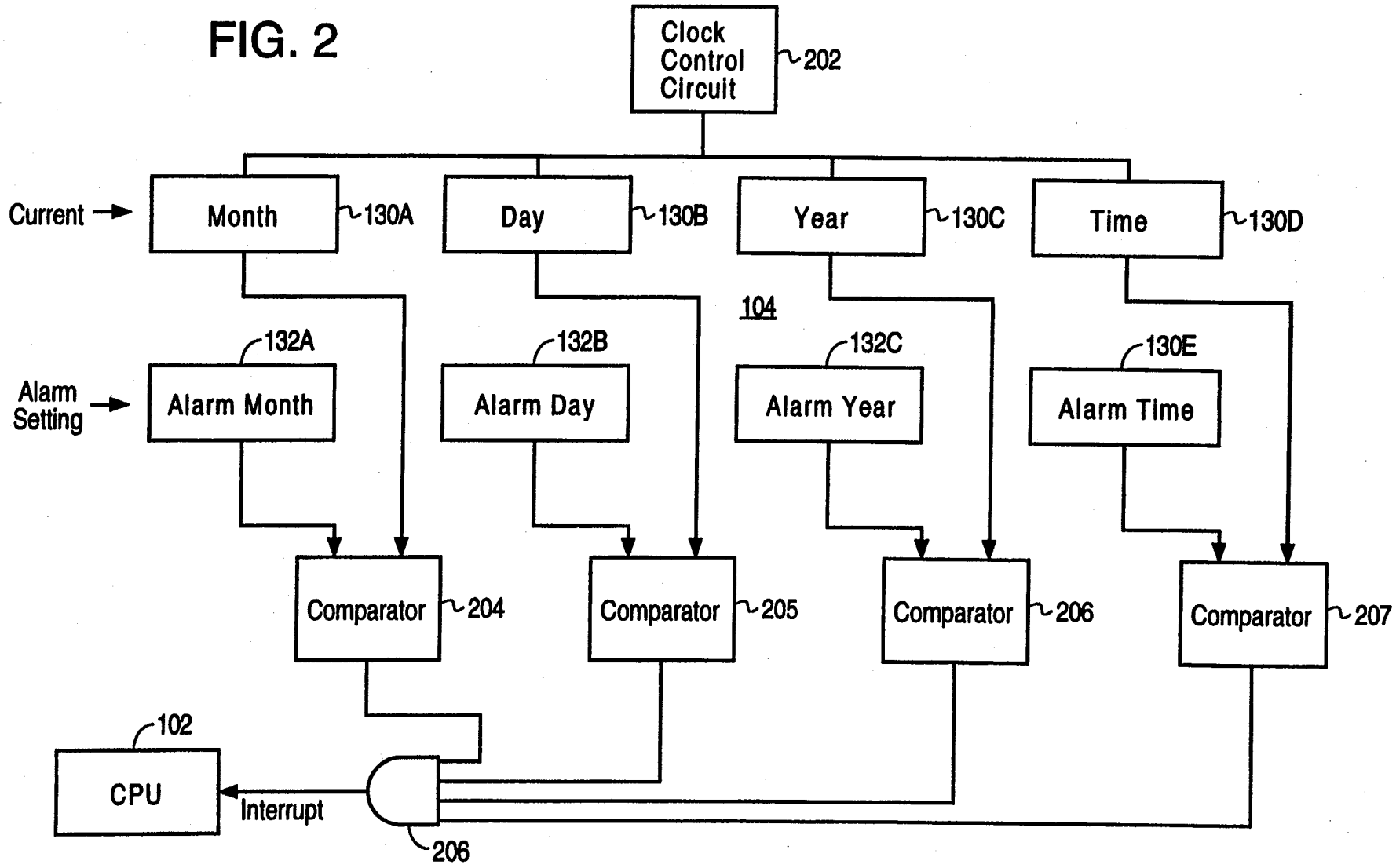
FIG. 2 is a block diagram of a portion of the computer system which illustrates clock control and comparator circuitry associated with the real time clock of FIG. 1.

Referring next to FIG. 2, a block diagram of another portion of real time clock circuit 104 is illustrated. Circuit portions that correspond to those of FIG. 1 are numbered identically for simplicity and clarity.

FIG. 2 illustrates the clock control circuit 202 that controls the current time and date within configuration registers 130A–130D. A set of comparators 204–207 are further provided for comparing the current time and date information with the alarm time and date information (stored within configuration registers 130E and 132A–132C). An output of each comparator 204–207 is coupled to a respective input terminal of an AND gate 206, which asserts an interrupt signal to microprocessor 102 high if the current time and date information matches the alarm time and date information. In other words, the output of AND gate 206 triggers an RTC alarm event.

In accordance with the real time clock described above in conjunction with FIGS. 1 and 2, a real time clock alarm circuit is provided that allows the setting of both the alarm time as well as the alarm date. As a result, system software is not required to track the current date for a particular alarm event. System overhead is thereby minimized. In addition, since the indexed configuration registers that store the alarm month, alarm day, and alarm year information are shadowed with respect to the configuration registers that store the current date information, and are selected by the same I/O index values, additional indexed I/O space of the computer system 100 is not occupied. As a result, the real time clock circuit will not present compatibility conflicts with other I/O peripheral devices which may be incorporated within the computer system.

Numerous variations and modifications will become apparent to those skilled in the art once the above disclosure is fully appreciated. For example, it is noted that although configuration register 112 is mapped within the configuration space of computer system 100, configuration register 112 could alternatively be mapped within the I/O or memory space of computer system 100. In addition, it is noted that the date information stored by the real time clock may comprise only day information, or only month and day information, depending upon the desired selectivity of the real time clock alarm circuit. It is intended that the following claims be interpreted to embrace all such variations and modifications.

What is claimed is:

1. A real time clock circuit for a computer system comprising:

a first register for storing a value indicative of the current time;

a second register for storing a value indicative of the current day;

a third register for storing a value indicative of a time for a desired RTC alarm event;

a fourth register for storing a value indicative of a day for said desired RTC alarm event;

an index decoder coupled to said first, said second, said third, and said fourth registers, wherein said index decoder is capable of selecting at least one of said registers depending upon an index value;

an index register coupled to said index decoder for storing said index value; and a configuration register for storing a configuration bit, wherein said configuration bit controls whether said third register or said fourth register is enabled during a designated I/O cycle.

2. The real time clock circuit as recited in claim 1 wherein said configuration register is mapped within a configuration space of said computer system.

3. The real time clock circuit as recited in claim 1 wherein said index decoder selects both said third register and said fourth register when a predetermined index value is stored within said index register.

4. The real time clock circuit as recited in claim 1 further comprising a cycle decoder coupled to said configuration register and to said index register, wherein said cycle decoder is for decoding cycles executed on a system bus of said computer system.

5. The real time clock circuit as recited in claim 4 wherein said cycle decoder is capable of causing data to be latched within said configuration register when a configuration cycle to a predetermined address is executed on said system bus.

6. The real time clock circuit as recited in claim 4 wherein said cycle decoder is capable of causing data to be latched within said index register when an I/O write cycle to a predetermined address is executed on said system bus.

7. The real time clock circuit as recited in claim 4 wherein said cycle decoder is capable of providing a write control signal to said first, said second, said third, and said fourth registers when an I/O write cycle to a predetermined address is executed on said system bus.

8. The real time clock circuit as recited in claim 7 wherein the writing of data into either said first, said second, said third, or said fourth register is dependent upon which of said registers is selected by said index value and upon said configuration bit.

9. The real time clock circuit as recited in claim 1 further comprising a first comparator circuit coupled to said second register and said fourth register for determining whether said value indicative of said current day equals said value indicative of said day for said desired RTC alarm event.

10. The real time clock circuit as recited in claim 9 further comprising a second comparator circuit coupled to said first register and to said third register and capable of determining whether said value indicative of said current time equals said value indicative of said time for said desired RTC alarm event.

11. The real time clock circuit as recited in claim 10 further comprising a logic circuit capable of asserting an RTC alarm if said value indicative of said current time equals said value indicative of said time for said desired RTC alarm event and if said value indicative of said current day equals said value indicative of said day for said desired RTC alarm event.

12. The real time clock circuit as recited in claim 11 wherein said assertion of said RTC alarm causes an assertion of an interrupt signal to a microprocessor of said computer system.

13. The real time clock circuit as recited in claim 1 further comprising:

a fifth register for storing a vale indicative of the current month; and a sixth register for storing a value indicative of a month for said desired RTC alarm event;

wherein said index decoder is further coupled to said fifth and sixth registers, and wherein said index decoder is capable of selecting said fifth and said sixth register depending upon said index value.

14. The real time clock circuit as recited in claim 13 wherein said configuration bit controls whether said fifth register or said sixth register is enabled during another designated I/O cycle.

15. A method for operating a real time clock circuit within a computer system comprising the steps of:

setting a configuration bit of a configuration register in a first state to enable a first set of registers;

storing a value indicative of the current time within a first register of said first set of registers;

storing a value indicative of the current day within a second register of said first set of registers;

storing a value indicative of a time for a desired RTC alarm event within a third register of said first set of registers;

setting said configuration bit of said configuration register in a second state to enable a fourth register, wherein said fourth register is associated with an I/O index value which is the same as an I/O index value associated with either said first of said second register; and storing a value indicative of a day for said desired RTC alarm event into said fourth register.

16. The method for operating a real time clock circuit as recited in claim 15 comprising the further step of storing said I/O index value within an index register to select said first register before said step of storing said value indicative of the current time.

17. The method for operating a real time clock circuit as recited in claim 16 comprising the further step of storing said I/O index value into said index register for selecting said fourth register before performing said step of storing said value indicative of a day for said desired RTC alarm event.

18. The method for operating a real time clock circuit as recited in claim 15 wherein said step of storing said value indicative of the current time is performed by executing an I/O cycle.

19. The method for operating a real time clock circuit as recited in claim 15 wherein said step of setting a configuration bit of said configuration register in a second state is performed by executing a write cycle to a configuration state of said computer system.

* * * * *